US006388221B1

(12) United States Patent
Rudolph et al.

(10) Patent No.: US 6,388,221 B1
(45) Date of Patent: May 14, 2002

(54) WINDOW WINDER SWITCH

(75) Inventors: Gerd Rudolph, Aspisheim (DE); Josef Khoury, Farmington Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/176,399

(22) Filed: Aug. 24, 2001

Related U.S. Application Data

(63) Continuation-in-part of application No. 08/853,014, filed on May 8, 1997, now abandoned.

(30) Foreign Application Priority Data

May 11, 1996 (DE) ..... 199 19 124

(51) Int. Cl.[7] ..... H01H 21/00
(52) U.S. Cl. ..... 200/556; 200/339
(58) Field of Search ..... 200/6 A, 339, 200/553–563, 330

(56) References Cited

U.S. PATENT DOCUMENTS 3,105,130 A * 9/1963 Weiford, Jr. ..... 200/556 X
3,679,846 A * 7/1972 Dillon et al. ..... 200/6 A X
3,684,850 A * 8/1972 Kaderbek et al. ..... 200/556 X
4,117,280 A * 9/1978 Feaster ..... 200/339 X
4,215,257 A * 7/1980 Repplinger ..... 200/330 X
4,429,000 A * 1/1984 Glenn et al. ..... 200/339
4,778,964 A * 10/1988 Kamisada ..... 200/339 X
4,876,493 A * 10/1989 Suzuki ..... 318/293
5,446,253 A * 8/1995 Oshgan ..... 200/556
5,515,508 A * 5/1996 Ogawa et al. ..... 200/1 B X
5,749,459 A * 5/1998 Balaban et al. ..... 200/559

FOREIGN PATENT DOCUMENTS

DE 2748835 C3 * 5/1978
WO WO 97/43777 * 11/1977

* cited by examiner

*Primary Examiner*—J. R. Scott
(74) *Attorney, Agent, or Firm*—Thomas A. Twomey

(57) ABSTRACT

A toggle switch (1), notably a window regulator switch in a motor vehicle, comprises a switch housing (2) in which a spring-biased toggle lever (12) is arranged in at least one switching limit position and a dead-center position. The toggle lever (12) comprises at least one switch-operating lever portion (25) that actuates at least one switching assembly (20), the toggle lever (12) featuring a center projection in which a spring-loaded catch unit (18) is fitted which interacts with a cam curve (9) contingent on the position of the toggle lever (12). To reduce the overall volume of the switch housing (2) and compensate for construction-related tolerances, the switch housing comprises a receiving part (5) that is integral with it, in which the toggle lever (12) is fitted, and in which at the same time the cam curve (9) is integrated, with the receiving part (5) enclosing the at least one switching assembly (20) and the at least one switch-operating lever portion (25).

15 Claims, 4 Drawing Sheets

WINDOW WINDER SWITCH

CROSS-REFERENCE TO RELATED APPLICATIONS

This application is a Continuation-In-Part of application Ser. No. 08/853,014 filed May 8, 1997, now abandoned.

STATEMENT REGARDING FEDERALLY SPONSORED RESEARCH OR DEVELOPMENT

Not Applicable.

MICROFICHE APPENDIX

Not Applicable.

BACKGROUND OF THE INVENTION

The invention relates to a toggle switch, notably a window regulator switch in a motor vehicle, comprising a switch housing in which a toggle lever is by means of spring force disposed in at least one switching limit position and a dead-center position. The toggle lever has at least one switch-operating lever portion for actuation of at least one switching assembly; and the toggle lever features a center projection in which a spring-loaded catch unit is inserted and which interacts with a catch cam for detenting the toggle lever position.

Motor vehicles are increasingly equipped with electrically actuated window regulator switches for all doors. A separate window regulator switch is provided for each door of the motor vehicle, operated by a push button or toggle lever. The push buttons or toggle levers for actuation by the driver are commonly located either in the driver's door panel or on the center console.

Known from DE 27 48 835 C3 is an automotive toggle switch featuring a toggle lever fitted in a top part of a switch housing and having two switching limit positions in which the toggle lever bears on stationary stops, preloaded by means of spring force always on one of the stops. The toggle lever comprises two switch-operating lever portions that extend parallel to each other and engage a switching assembly with a pertaining contact bridge movable on contact tracks. Located between the switch-operating lever portions is a projection in which a spring-loaded detent is fitted that interacts with a track molded in the bottom of the housing top. The end of the detent facing the track is provided with a roller.

The switch housing of this aforesaid known toggle switch is divided into a housing top part and a housing bottom part, making it constructionally very expensive and bulky requiring much overall space. The bottom part houses the switching assembly and the contact bridge loaded by a compression spring, which are actuated by the switch-operating lever portions of the toggle lever. The switch-operating levers protrude for that purpose through an opening in the bottom of the housing top part, into the housing bottom part. The switching assembly in the housing bottom part is therefore spring-loaded additionally, in order to compensate for manufacturing and moving tolerances by the two-part design of the switch housing. This arrangement contributes to increasing the overall volume of the toggle switch.

BRIEF SUMMARY OF THE INVENTION

The objective of the present invention is to provide a toggle switch, notably a window regulator switch, that makes it possible to reduce the construction volume of the switch housing and compensate for design-related tolerances, while at the same time guaranteeing easy operability of the toggle switch.

This objective is satisfied by the present invention in that the switch housing comprises a receiving part that is integral with it, in which the toggle lever is fitted and the catch cam is also integrated with the receiving part enclosing the at least one switching assembly and the at least one switch-operating lever portion.

The single-part design of the switch housing with receiving part avoids dividing the switch housing in two, which produces a small overall volume for the switch housing. Moreover, the switch housing can be manufactured with the receiving part integrally formed in a single piece. Due to fitting the toggle lever and at the same time integrating the cam curve in the receiving part, tolerance advantages are created by the short distance between the toggle lever bearing and the catch unit sliding on the cam curve, which provides for easy operability of the toggle switch. As a result, the dead-center position of the toggle lever can be maintained exactly. Furthermore, a separation exists between haptics or lens and electrics. In addition, the switching point can be varied without affecting the actuating force. Lastly, the actuating force can be varied without influencing the point of contact.

To make sufficient space available for accommodating the arms of the toggle levers, respectively switching assemblies, the receiving part is in one embodiment of the invention fashioned substantially U-shaped, on the switch housing.

Moreover, the top side of the receiving part features preferably an at least partly circumscribing skirt, in which the toggle lever is fitted. This results in material savings and thus a weight reduction, since the receiving part is fashioned in the form of a skirt only in the region where the toggle lever is supported.

The switch housing with the integrated receiving part is preferably formed of plastic. This makes it possible to produce the receiving part as a single-step injection molding.

To protect the switch housing from environmental effects, such as moisture, the switch housing preferably allows sealing from below, with a base.

According to a further embodiment of the invention, the toggle lever has a switch-operating lever portion that is spaced from the center projection and actuates the coordinated switching assembly. Pressing the toggle lever causes its switching-operating lever portion to actuate the coordinated switching assembly by loading it, so that in this switching limit position the associated corresponding window in the motor vehicles is lowered. Releasing the toggle lever causes it to be moved by the spring-loaded catch unit to its dead-center position, which at the same time represents a switching limit position in which the switch-operating lever portion relieves the switching assembly, thus closing the window again.

According to an alternative embodiment of the invention, the toggle lever is equipped with two switch-operating lever portions spaced from the projection disposed one on each end of the toggle lever, each actuating a coordinated switching assembly. Pressing on one side of the toggle lever causes it to move from its dead-center position to one switching limit position, with the one switch-operating lever portion acting on the associated switching assembly and opening the window in the motor vehicle door. Upon release, the toggle lever restores to its dead-center position. Pressing the toggle lever in the opposite direction to its other switching limit position causes the other switch-operating lever portion to actuate the associated second switching assembly, thus closing the window.

Each switching assembly is preferably a microswitch adapted for assembly to the receiving part of the switch housing. To convey to the user an improved switching feel, the microswitch is one of long-stroke design, enabling its stem to perform a specific, longer travel until the onset of the switching function. Furthermore, the actuating force of the microswitch is less than 0.5 N, in order to improve the switching feel.

The present microswitch design has different switching functions that can be activated depending on the position of its stem actuated by the coordinated switch-operating lever of the toggle lever. The respective microswitch may be fashioned such that a short-duration, or short-stroke actuation of the toggle lever occasions only a short-duration and partial lowering or raising of the window in the door of the motor vehicle. In contrast, pressing the toggle lever longer or more forcefully may trigger a switching function that causes a complete lowering or raising of the window.

In terms of circuitry, the microswitch connects suitably to a printed circuit board disposed on the switch housing or to a stamped grid arranged outside the switch housing. With the microswitch not contained directly on the printed circuit board or stamped grid, but in the receiving part of the switch housing, the dimensions of the printed circuit board or stamped grid comprising the LED's, series resistors, plugs and the like are reduced.

The cam curve integrated in the receiving part is preferably fashioned as a V-shaped sliding track for the catch unit of the toggle lever. The V-shaped cam profile occasions the exact dead-center position, i.e., the rest position of the toggle switch. The spring-loaded catch unit in the projection molded to the underside of the toggle lever always forces the toggle lever to be restored, upon release, to its exact dead-center position. Furthermore, the V-shaped sliding track for the catch unit of the toggle lever expands unevenly, starting from its inverse vertex. This means that the V-shaped sliding track expands increasingly from the inverse vertex upward. This conveys to the user a tactile switching feel, due to the specific catch cam geometry, thus improving the operability of the toggle switch.

The invention is described hereafter in greater detail with the aid of an exemplary embodiment and with reference to the pertaining drawing.

DETAILED DESCRIPTION OF THE INVENTION

Figure 1:
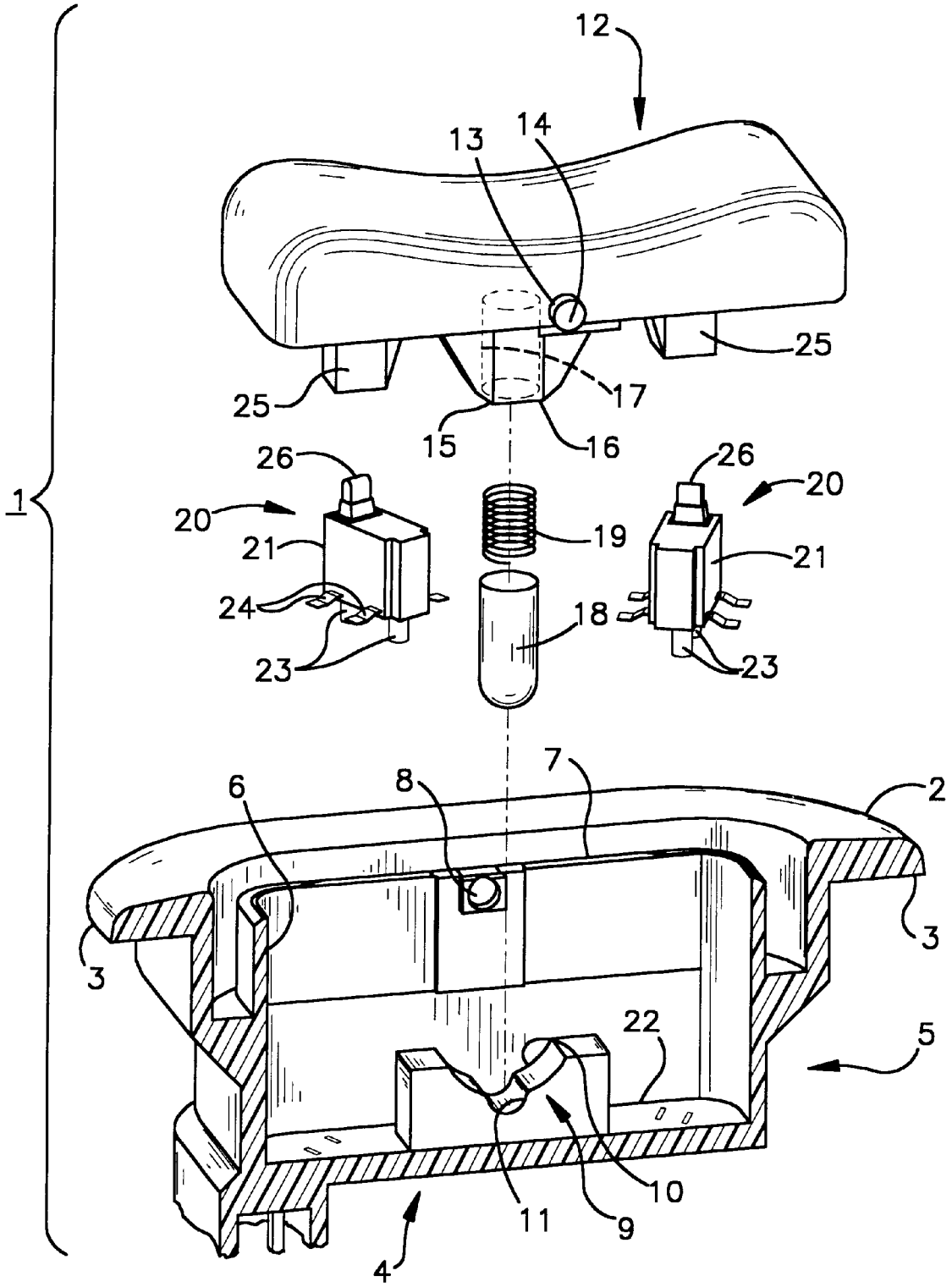
FIG. 1 is an exploded view of the inventional toggle switch, illustrating the switch housing sectioned along its longitudinal plane.

The inventional toggle switch indicated generally at 1 with its switch housing 2 is fashioned as an add-on apparatus inserted to the stops 3 into an opening (not illustrated), for example, in a door panel or center console of a motor vehicle. Housing 2 has a base indicated generally at 4 which it will be understood serves to seal the underside of the switch housing 2. A receiving part indicated generally at 5 is molded integrally as once piece with the switch housing 2 and is substantially U-shaped. Apart from the receiving part 5, the switch housing 2 comprises a cavity 6.

The receiving part 5 features on its top rim a circumscribing skirt 7, which on each of the longer opposite sides of the receiving part 5 is provided with a hole 8. A catch cam indicated generally at 9 provided with a V-shaped cam track 10 extends in the center longitudinal plane of the receiving part 5. The V-shaped cam track expands upwardly unevenly from its inverse vertex 11.

A toggle lever 12 fits in the U-shaped receiving part 5. Toggle lever 12 features a centered, sideways protruding stub axle 13 for assembly in the hole 8 in the skirt 7 of the receiving part 5. Thus, the toggle lever 12 is pivotable about an axis 14. A projection 15 extends perpendicularly beneath the visible surface of toggle lever 12; and, the projection is formed integrally with the toggle lever 12. The projection 15 features a blind hole 17 formed therein for receiving a pin type catch unit or plunger 18, on the upper end of which acts a compression spring 19. The upper end of compression spring 19 bears on the bottom of blind hole 17, when catch unit 18 is fitted in blind hole 17 in the projection 15. The slots 16 in the projection 15 of toggle lever 12 bring about a smooth movability of plunger 18 in the projection 15. With the toggle lever 12 fitted in the receiving part 5, the plunger 18 engages the V-shaped cam track 10 in the cam profile 9, so that the tip of plunger 18 bears in the inverse vertex 11 of the V-shaped sliding track 10, and is pressed onto it by compression spring 19.

Figure 2:
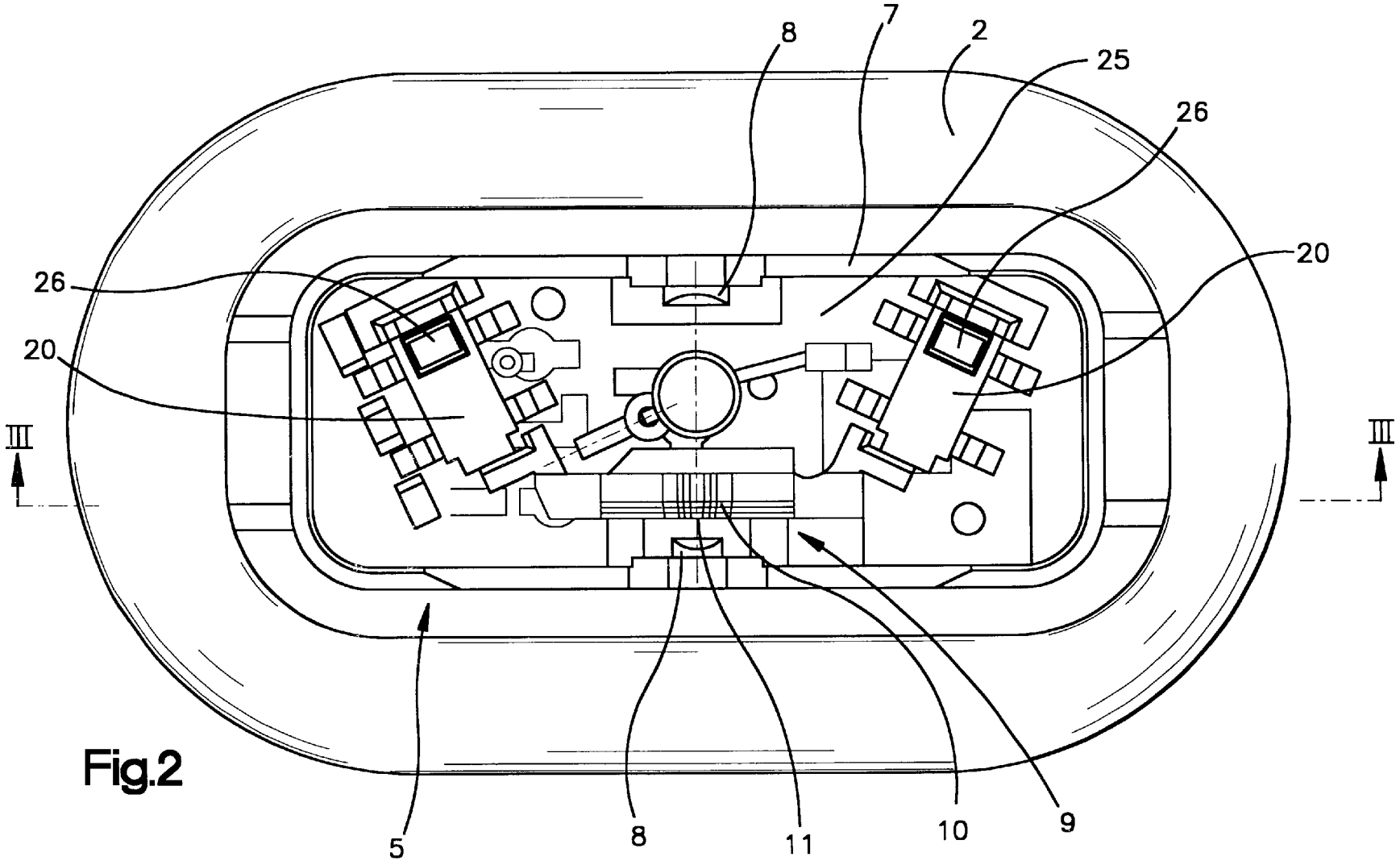
FIG. 2 is a top view of the assembled switch of FIG. 1 with the toggle lever 12 omitted to show the microswitch mountings.
Figure 3:
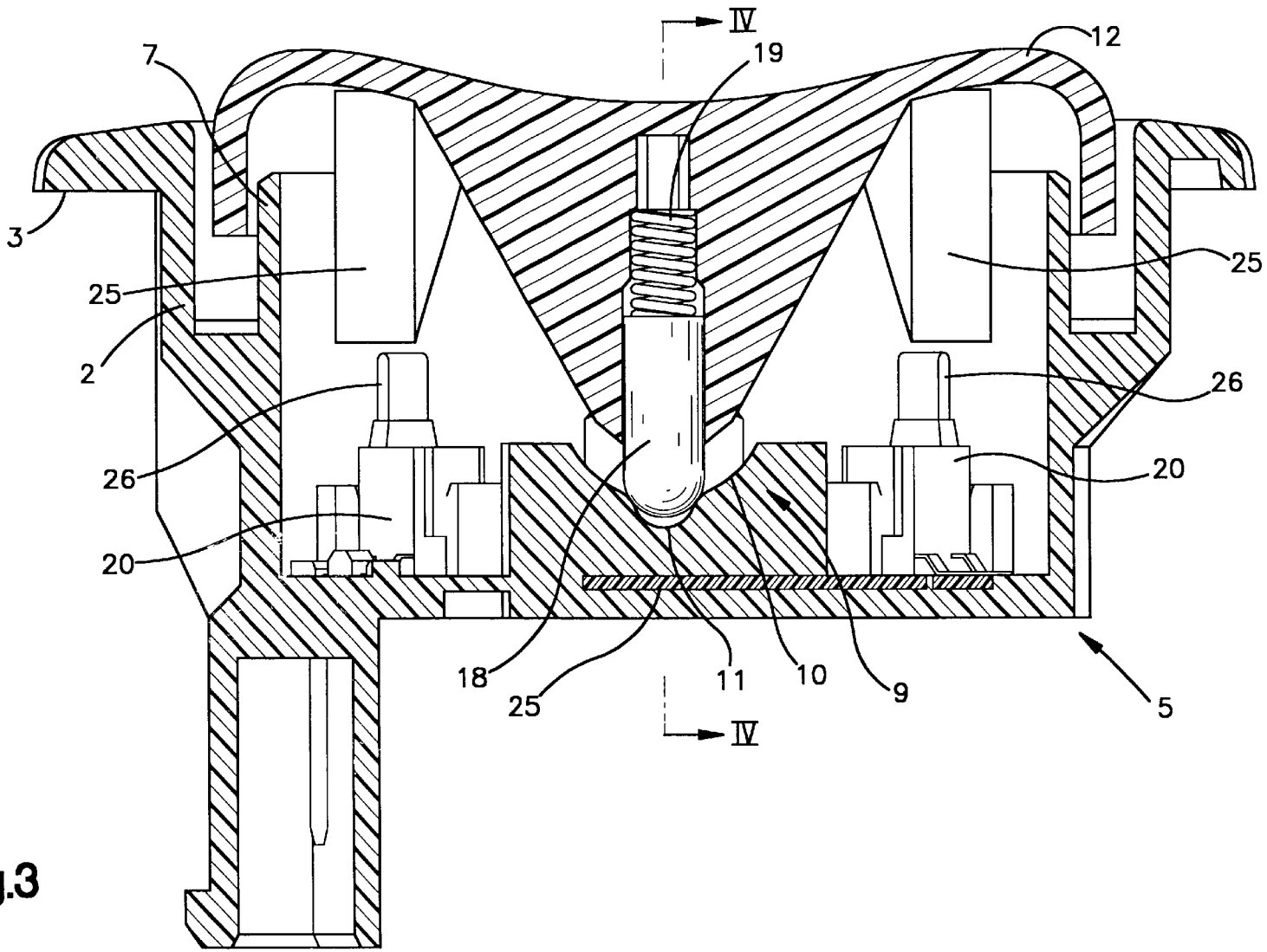
FIG. 3 shows an enlarged longitudinal section taken through the midplane of the assembled switch of FIG. 1; and, FIG. 4 is an enlarged section view taken along the transverse midplane of the assembled switch of FIG. 1.
Figure 4:
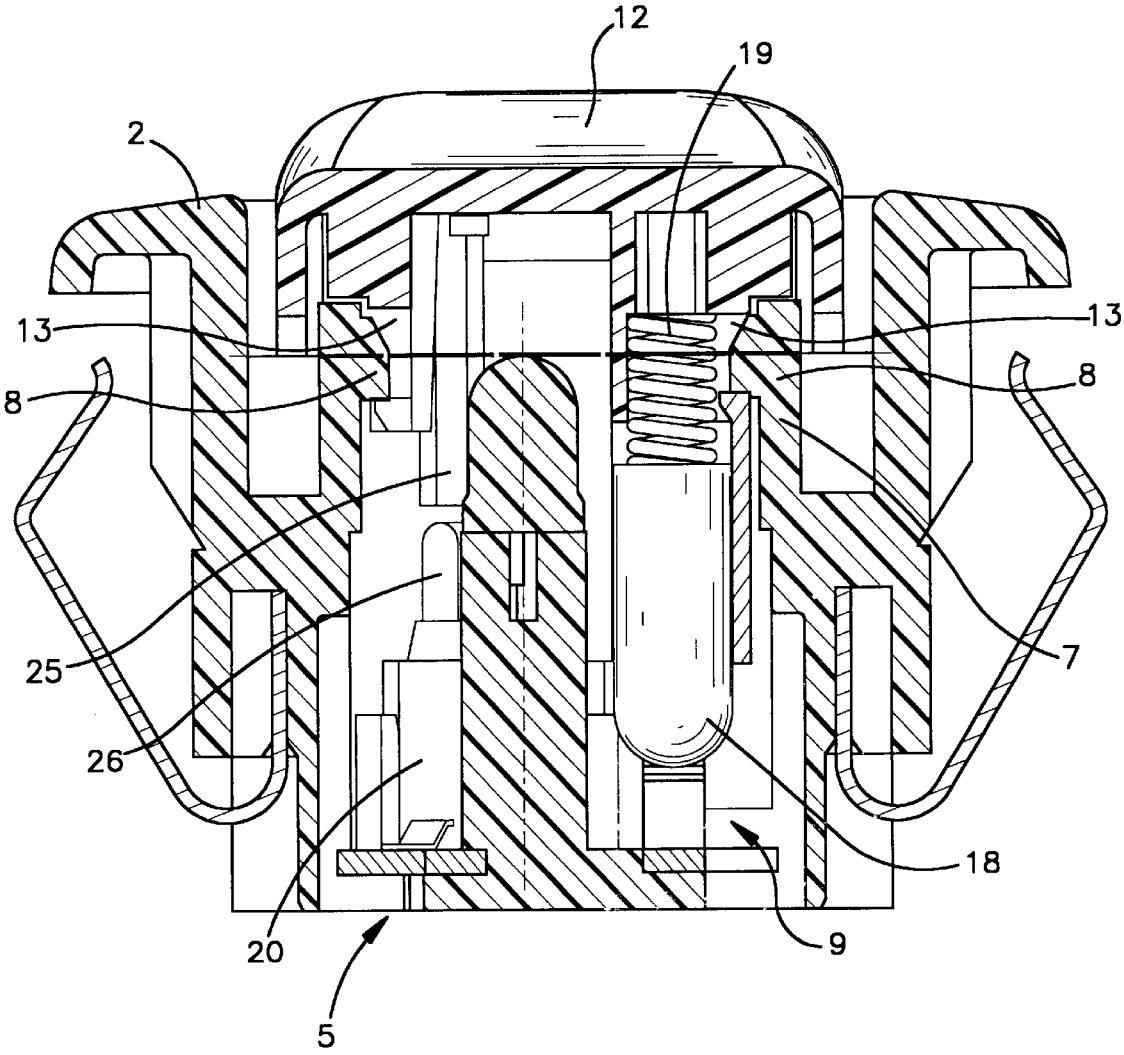

Also provided are two switching assemblies indicated generally at 20 preferably comprising microswitches 21, which are disposed on both sides of projection 15 of toggle lever 12, with mutual spacing, and fastened to a mounting surface 22 preferably comprising the bottom of housing 2 in a way such that the lock pins 23 disposed on the underside of the microswitches 21 grip, in assembled state, the mounting surface 22 of the circumscribing skirt 7 in the receiving part 5. Each microswitch 21 features several contact lugs 24, which in terms of circuitry connect to a printed circuit board 25 contained on the inside of the bottom 22 switch housing 2 as shown in FIGS. 2 and 3.

In agreement with switching assemblies 20, two switch-operating lever portions 25 are contained on the underside of toggle lever 12 with mutual spacing, fashioned integrally with the toggle lever 12 and each located commonly with one of the switching assemblies 20. With toggle lever 12 inserted in the receiving part 5, the switch-operating lever portions 25 are disposed directly opposite the stems or operating buttons 26 of the microswitches 21.

Pivoting the toggle lever 12, for example, clockwise, causes the plunger 18 to slip out of inverse vertex 11 of cam curve 9 and move along the left side of the V-shaped cam track 10. The right-hand switch-operating lever portion 25 actuates, at the same time, stem 26 of the corresponding associated microswitch 21, thereby triggering a switching function, for example, lowering the door window of a motor vehicle. Upon release of toggle lever 12, compression spring 19 forces the plunger 18 back into inverse vertex 11 of V-shaped cam track 10 in the cam profile 9, with toggle lever 12 being restored back to its dead-center position. Switch-operating lever portion 25 disengages, at the same time, stem 26 of the associated corresponding microswitch, interrupting the respective switching function. The same operation repeats when actuating the left-hand side of toggle lever 12. Although the invention has hereinabove been described with respect to the illustrated embodiments, it will be understood that the invention is capable of modification and variation and is limited only by the following claims.

What is claimed is:

1. A toggle switch comprising a switch housing having a toggle lever thereon spring biased in at least one switching limit position and a dead-center position, said toggle lever actuating at least one switching assembly, said toggle lever featuring a center projection having a spring-loaded catch unit slidable thereon which, depending on the toggle lever position, interacts with a cam track, characterized in that the switch housing comprises a receiving part that is integral with the switch housing, in which the toggle lever is fitted and in which the cam curve track is integrated, the receiving part enclosing the at least one switching assembly and the at least one switch-operating lever.

2. Toggle switch according to claim 1, characterized in that the receiving part is fashioned substantially U-shaped on the switch housing.

3. Toggle switch according to claim 1, characterized in that the top side of the receiving part features an at least partly circumscribing skirt in which the toggle lever is fitted.

4. Toggle switch according to claim 1, characterized in that the switch housing with the integrated receiving part is formed of plastic.

5. Toggle switch according to claim 1, characterized in that the switch housing can be sealed from below by a base element.

6. Toggle switch according to claim 1, characterized in that the toggle lever features a switch-operating lever spaced from the projection and actuating the pertaining switching assembly.

7. Toggle switch according to claim 1, characterized in that the toggle lever is on both sides equipped with switch-operating levers spaced from the projection and actuating each a coordinated switching assembly.

8. Toggle switch according to claim 1, characterized in that each switching assembly is a microswitch fastened to the receiving part of the switch housing.

9. Toggle switch according to claim 8, characterized in that the microswitch is of long-stroke design.

10. Toggle switch according to claim 8, characterized in that the actuating force of the microswitch is less than 0.5 N.

11. Toggle switch according to claim 8, characterized in that the microswitch covers different switching functions that can be activated in contingence on the position of its stem actuated by the pertaining switch-operating lever of the toggle lever.

12. Toggle switch according to claim 8, characterized in that the microswitch is suited for assembly to the receiving part of the switch housing.

13. Toggle switch according to claim 8, characterized in that the microswitch connects in circuitry terms to a printed circuit board arranged outside the switch housing or to a stamped grid arranged outside the switch housing.

14. Toggle switch according to claim 1, characterized in that the cam curve integrated in the receiving part is fashioned as a V-shaped cam for the catch unit of toggle lever.

15. Toggle switch according to claim 14, characterized in that the V-shaped cam track for the catch unit of toggle lever expands unevenly from the inverse vertex.

* * * * *